US006818816B2

(12) United States Patent
Roberts et al.

(10) Patent No.: US 6,818,816 B2
(45) Date of Patent: Nov. 16, 2004

(54) PERSONAL AMPLIFICATION SOUND SYSTEM

(75) Inventors: Theodore Roberts, 2750 W. 70th St., Chicago, IL (US) 60629; Brian E. Ainsworth, Ada, MI (US)

(73) Assignee: Theodore Roberts, Chicago, IL (US)

( * ) Notice: Subject to any disclaimer, the term of this patent is extended or adjusted under 35 U.S.C. 154(b) by 0 days.

(21) Appl. No.: 10/301,123

(22) Filed: Nov. 21, 2002

(65) Prior Publication Data

US 2004/0099130 A1 May 27, 2004

(51) Int. Cl.[7] ..... G10H 3/00
(52) U.S. Cl. ..... 84/723; 381/301; 2/102
(58) Field of Search ..... 84/723; 381/333, 381/382, 301; 2/102

(56) References Cited

U.S. PATENT DOCUMENTS 4,539,700 A * 9/1985 Sato ..... 381/333
4,589,134 A * 5/1986 Waldron ..... 381/301
4,825,471 A * 5/1989 Jennings ..... 2/94
4,876,724 A * 10/1989 Suzuki ..... 381/385
5,212,734 A * 5/1993 Tsao ..... 381/388
5,563,951 A * 10/1996 Wang et al. ..... 381/301
5,774,338 A * 6/1998 Wessling, III ..... 361/730
6,097,822 A * 8/2000 Min ..... 381/301
6,243,870 B1 * 6/2001 Graber ..... 2/69
2002/0145849 A1 * 10/2002 Peterson, III ..... 361/683

* cited by examiner

*Primary Examiner*—Jeffrey W Donels
(74) *Attorney, Agent, or Firm*—Price, Heneveld, Cooper, DeWitt & Litton, LLP.

(57) ABSTRACT

A personal amplification sound system includes a microphone adapted to receive a sound and convert the sound into an original source signal, and an amplifier in operable communication with the microphone and adapted to receive the original source signal from the microphone and amplify the original source signal, thereby resulting in an amplified signal. The personal amplification sound system also includes at least one speaker in operable communication with the amplifier and adapted to receive the amplified signal from the amplifier, and an article of clothing adapted to the worn by a user, and that houses the amplifier and the at least one speaker therein.

22 Claims, 1 Drawing Sheet

PERSONAL AMPLIFICATION SOUND SYSTEM

BACKGROUND OF THE INVENTION

The present invention relates to a sound system, and in particular to a sound system adapted to be worn by the user.

Personal amplification or PA systems are used in a wide variety of applications, such as during crowd control, emergency response, sporting events, at school functions, and the like. These sound systems typically include a receiver to receive a particular sound, an amplifier to amplify the sound received, and a speaker to broadcast the amplified sound. These PA systems typically are self contained units and require the user to use at least one hand to operate the PA system at all times, thereby limiting the tasks that can be simultaneously performed by the user while operating the PA system.

A need exists for a personal amplification sound system that provides hands-free use of the PA system, thereby allowing the user to accomplish simultaneous tasks while using the PA system.

SUMMARY OF THE INVENTION

One aspect of the present invention is to provide a personal amplification sound system that includes a microphone adapted to receive a sound and convert the sound into an original source signal, and an amplifier in operable communication with the microphone and adapted to receive the original source signal from the microphone and amplify the original source signal, thereby resulting in an amplified signal. The personal amplification sound system also includes at least one speaker in operable communication with the amplifier and adapted to receive the amplified signal from the amplifier, and an article of clothing adapted to be worn by the user that houses the amplifier and the at least one speaker therein.

Another aspect of the present invention is to provide a personal amplification sound system that includes a headset adapted to be worn by a user, and that includes a microphone adapted to receive a sound and convert the sound into an original source signal, and an ear piece adapted to broadcast the original source signal to the user, and an amplifier in operable communication with the microphone and adapted to receive the original source signal from the microphone and amplify the original source signal, thereby resulting in an amplified signal, and wherein the amplifier includes an on/off switch. The personal amplification sound system also includes at least one speaker in operable communication with the amplifier and adapted to receive the amplified signal from the amplifier, and a vest adapted to be worn by the user and that includes a first pocket that is accessible to an interior of the vest, wherein the first pocket receives the amplifier therein, a second pocket that is accessible from the interior of the vest, wherein the second pocket receive the at least one speaker therein, and a perforated material covering the exterior region substantially proximate the speaker.

The present inventive personal amplification sound system is efficient to use by allowing hands-free operation thereof, economical to manufacture, and is particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
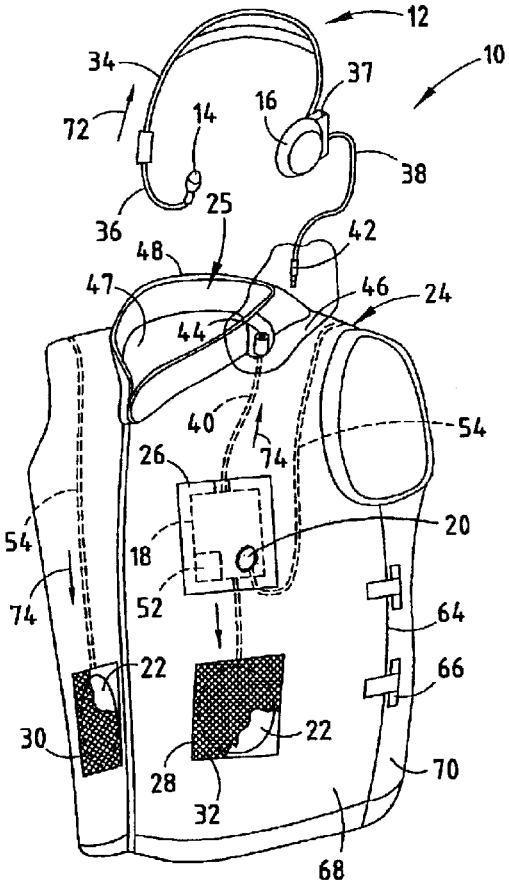
FIG. 1 is a perspective view of the personal amplification sound system embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 (FIG. 1) generally designates a personal amplification sound system embodying the present invention. In the illustrated example, the sound system 10 includes a headset 12 adapted to be worn by a user, that includes a microphone 14 adapted to receive a sound and convert the sound into an original source signal, and an ear piece 16 adapted to broadcast the original source signal to the user. The sound system 10 also includes an amplifier 18 in operable communication with the microphone 14 and adapted to receive the original source signal from the microphone 14 and amplify the original source signal, thereby resulting in an amplified signal, and an on/off control switch 20. The sound system 10 further includes at least one speaker in operable communication with the amplifier 18 and adapted to receive the amplified signal from the amplifier 18, and a vest 24 adapted to be worn by the user and that includes a first pocket 26 that is accessible from an interior 25 of the vest 24, as discussed below, wherein the first pocket 26 receives the amplifier 18 therein, a second pocket 28 that is accessible from the interior 25 of the vest 24, wherein the second pocket 28 receives a speaker 22 therein, a third pocket 30 that is accessible from the interior 25 of the vest 24, wherein the third pocket 30 receives a speaker 22 therein, and a perforated material covering the exterior region substantially proximate the speakers 22.

Figure 2:
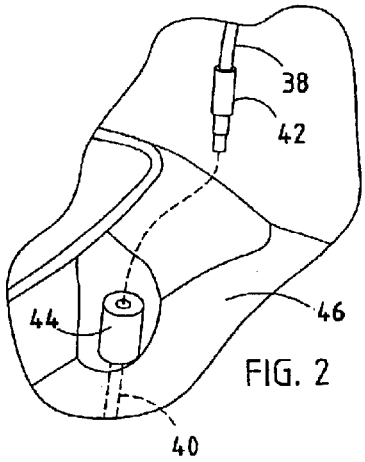
FIG. 2 is an enlarged perspective view of an audio quick-connect adapter of the sound system.

The headset 12 includes the microphone 14 which is supported from a slidably adjustable body 34 by an adjustable boom 36, thereby allowing the user to adjust the size of the body 34, as well as the location of the microphone 14 with respect to the user's mouth. The microphone 14 is preferably a voice-activated microphone, thereby eliminating the necessity of a physical input to the sound system 10 to broadcast the sound therefrom. In the illustrated example, the headset 12 includes a single ear piece 16, however, an additional ear piece (not shown) may be added to the opposite side of the headset 12. The headset 12 is operably connected to the amplifier 18 via a first communication line 38 and a second communication line 40 woven into the vest 24 between an exterior surface 46 and an interior surface 47 thereof. An audio-type, quick-connect plug member 42 (FIG. 2) and an audio-type, quick-connect receiver member located within the exterior surface 46 of the vest 24 provide an easy connection between communication lines 38 and 40. In the illustrated example, the receiver member 44 is located near a collar portion 48 of the vest 24, however, other locations may be utilized. The headset 12 further includes a light source 37 in operable communication with the amplifier 18, and that is switchable between an on position, corresponding to an on condition of the amplifier 18, and an off position, corresponding to an off condition of the amplifier 18.

Figure 3:
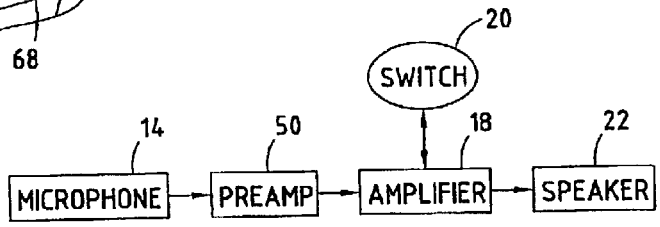
FIG. 3 is a schematic diagram of a communication circuit of the personal amplification sound system.

The amplifier 18 is utilized to amplify the original source signal as received from the headset 12, thereby resulting in an amplified signal. Preferably, a pre-amp 50 (FIG. 3) is preferably included within the sound system 10, thereby providing greater clarity to the ultimate broadcast sound. A power unit 52 is provided within the amplifier 18, and which receives power from replaceable batteries located therein. In the illustrated example, the control switch 20 is a reostate-type switch, thereby allowing finite adjustment of the amplifier 18.

The speakers 22 are in operable communication with the amplifier 18 via wires 54 woven into the vest 24 between the exterior surface 46 and the interior surface 47, similar to the communication line 38. As illustrated, the speaker 22 located on an opposite side of the vest 24 from the amplifier 18 is connected by a communication line 54 that extends around the back of the vest 18, however, any suitable path from the amplifier 18 to the speakers 22 may be used. Each speaker 22 is preferably capable of at least 5 watts of amplitude, and are suitable for indoor and outdoor use.

Figure 4:
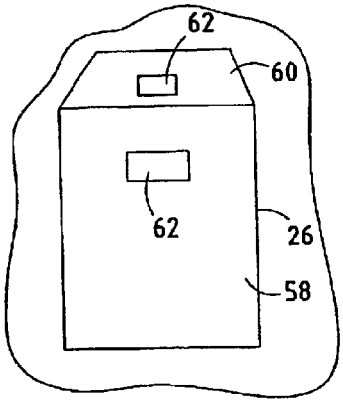
FIG. 4 is an enlarged side view of a pocket of the sound system.

The vest 24 is preferably constructed of a lightweight and durable material and includes the plurality of pockets 26, 28 and 30 (FIG. 4) for receiving the amplifier 18 and the speakers 22 therein. Each pocket 26, 28 and 30 is accessible from an interior of the vest 18. As each of the pockets 26, 28 and 30 are similar in construction, the description of the first pocket 26 is illustrative of pockets 28 and 30. The first pocket 26 includes a pocket portion 58 and flap portion 60 that is held in a closed position with the pocket portion 68 by a pair of mating hook-and-loop type fabric fasteners 62. In the illustrated example, the vest 24 is constructed such that the control switch 20 is accessible to the user on an exterior of the vest 24, thereby allowing adjustment of the amplifier 18 without requiring the user to access the interior 25 of the vest 24. The perforated material 32 covering the exterior regions of the vest 24 substantially proximate the speakers 22 allows a less muffled delivery of the ultimate broadcast sound as delivered by the speakers 22. It should be noted that other materials allowing undistorted transmission of the ultimate broadcast sound may also be utilized. The vest 24 provides for size adjustment via slits 64 located beneath the arms of the user. A pair of hook-and-loop type fabric fasteners 66 are located along the length of each slit 64, and are positioned so as to allow adjustment of the gap between the front portion 68 and the rear portion 70 of the vest 24.

In operation, the user broadcasts a sound which is picked up by the microphone 14 and which converts the sound into an original source signal traveling in a direction as indicated by directional arrow 72. The original source signal 72 then travels along the communication lines 38 and 40 and is received by the amplifier 18, that amplifies the original source signal 72, thereby resulting in an amplified signal traveling in a direction as indicated by directional arrows 74 and which are received by the speakers 22.

The present inventive personal amplification sound system is efficient to use by allowing hands-free operation thereof, economical to manufacture, and is particularly well adapted for the proposed use.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A personal amplification sound system, comprising:

a microphone adapted to receive a sound and convert the sound into an original source signal;

a headset adapted to be worn by a user, and that includes the microphone therein, thereby allowing hands-free use of the microphone;

an amplifier in operable communication with the microphone and adapted to receive the original source signal from the microphone and amplify the original source signal, thereby resulting in an amplified signal;

at least one speaker in operable communication with the amplifier and adapted to receive the amplified signal from the amplifier; and an article of clothing adapted to be worn by a user, and that houses the amplifier and the at least one speaker therein.

2. The amplification sound system of claim 1, wherein the headset further includes an ear piece adapted to broadcast the original source signal to the user.

3. The amplification sound system of claim 1, wherein the headset includes a light source in operable communication with the amplifier, and switchable between an on position, corresponding to an on condition of the amplifier, and an off position, corresponding to an off condition of the amplifier.

4. The amplification sound system of claim 1, wherein the amplifier includes an on/off control switch.

5. The amplification sound system of claim 4, wherein, the control switch of the amplifier allows the user to adjust a strength of the amplified signal.

6. The amplification sound system of claim 5, wherein the control switch is accessible from an exterior of the article of clothing when the article of clothing is being worn by the user.

7. The amplification sound system of claim 4, wherein the article of clothing is a vest.

8. The amplification sound system of claim 7, wherein the vest includes a side slit extending along each side of the vest, and at least one adjustment strap operably connected with the vest such that an adjustment of a length of the strap adjusts a size of the vest.

9. The amplification sound system of claim 7, wherein the article of clothing includes a first pocket that is accessible from an interior thereof, and wherein the first pocket receives the amplifier therein.

10. The amplification sound system of claim 9, wherein the article of clothing includes a second pocket that is accessible from an interior thereof, and wherein the second pocket receives the at least one speaker therein.

11. The amplification sound system of claim 10, wherein the article of clothing includes a perforated material covering the exterior region substantially proximate the speaker.

12. The amplification sound system of claim 11, further including:

a preamplifier in operable communication with the microphone, and adapted to the receive the source signal from the microphone and amplify the source signal, thereby resulting in a pre-amplified signal.

13. The amplification sound system of claim 1, wherein the article of clothing is a vest.

14. The amplification sound system of claim 13, wherein the vest includes a side slit extending along each side of the vest, and at least one adjustment strap operably connected with the vest such that an adjustment of a length of the strap adjusts a size of the vest.

15. The amplification sound system of claim 1, wherein the article of clothing includes a first pocket that is accessible from an interior thereof, and wherein the first pocket receives the amplifier therein.

16. The amplification sound system of claim 1, wherein the article of clothing includes a second pocket that is accessible from an interior thereof, and wherein the second pocket receives the at least on speaker therein.

17. The amplification sound system of claim 1, wherein the article of clothing includes a perforated material covering the exterior region substantially proximate the speaker.

18. The amplification sound system of claim 1, further including:

a preamplifier in operable communication with the microphone, and adapted to the receive the source signal from the microphone and amplify the source signal, thereby resulting in a pre-amplified signal.

19. The amplification sound system of claim 1, wherein the microphone is voice-activated.

20. The amplification sound system of claim 1, further including:

a quick-connect adapter accessible from an exterior of the article of clothing and adapted to operably couple the microphone to the amplifier.

21. The amplification sound system of claim 1, further including:

at least one communication line located between an exterior surface of the article of clothing and an interior surface of clothing.

22. A personal amplification sound system, comprising:

a headset adapted to be worn by a user, and that includes a microphone adapted to receive a sound and convert the sound into an original source signal, and an ear piece adapted to broadcast the original source signal to the user;

an amplifier in operable communication with the microphone and adapted to receive the original source signal from the microphone and amplify the original source signal, thereby resulting in an amplified signal, and including an on/off switch;

at least one speaker in operable communication with the amplifier and adapted to receive the amplified signal from the amplifier; and a vest adapted to be worn by the user and that includes a first pocket that is accessible from an interior of the vest, wherein the first pocket receives the amplifier therein, a second pocket that is accessible from the interior of the vest, wherein the second pocket receives the at least one speaker therein, and a perforated material covering the exterior region substantially proximate the speaker.

* * * * *